US008111860B2

(12) United States Patent
Retchin et al.

(10) Patent No.: US 8,111,860 B2
(45) **Date of Patent: *Feb. 7, 2012**

(54) RECREATIONAL BONE CONDUCTION AUDIO DEVICE, SYSTEM

(75) Inventors: Sheldon M. Retchin, Richmond, VA (US); Martin Lenhardt, Hayes, VA (US)

(73) Assignee: Virginia Commonwealth University, Richmond, VA (US)

( * ) Notice: Subject to any disclaimer, the term of this patent is extended or adjusted under 35 U.S.C. 154(b) by 1106 days.

This patent is subject to a terminal disclaimer.

(21) Appl. No.: 11/926,576

(22) Filed: Oct. 29, 2007

(65) Prior Publication Data

US 2008/0107289 A1 May 8, 2008

Related U.S. Application Data

(63) Continuation of application No. 10/628,563, filed on Jul. 29, 2003, now Pat. No. 7,310,427.

(60) Provisional application No. 60/399,699, filed on Aug. 1, 2002.

(51) Int. Cl.
*H04R 25/00* (2006.01)

(52) U.S. Cl. ..... 381/380; 381/151; 381/376

(58) Field of Classification Search ..... 381/151, 381/312, 326, 376, 378, 380; 2/209, 905; 379/430

See application file for complete search history.

(56) References Cited

U.S. PATENT DOCUMENTS

| | | | | |
|---|---|---|---|---|
| 1,329,029 | A * | 1/1920 | Timmons | 379/430 |
| 4,682,363 | A | 7/1987 | Goldfarb et al. | |
| 4,683,587 | A | 7/1987 | Silverman | |
| 4,791,673 | A | 12/1988 | Schreiber | |
| 4,821,323 | A * | 4/1989 | Papiernik | 381/370 |
| 5,034,995 | A | 7/1991 | Ciccone | |
| 5,047,994 | A | 9/1991 | Lenhardt et al. | |
| 5,125,032 | A * | 6/1992 | Meister et al. | 381/370 |
| 5,323,468 | A | 6/1994 | Bottesch | |
| 5,537,667 | A | 7/1996 | Kenning et al. | |
| 6,396,769 | B1 | 5/2002 | Polany | |
| 6,456,721 | B1 * | 9/2002 | Fukuda | 381/380 |
| 7,310,427 | B2 * | 12/2007 | Retchin et al. | 381/380 |

FOREIGN PATENT DOCUMENTS

| | | |
|---|---|---|
| WO | WO 00/01264 | 1/2000 |
| WO | WO 02/41750 | 5/2002 |

OTHER PUBLICATIONS

Cai, Zhi., et al., "Response of Human Skull to Bone-Conducted Sound in the Audiometric-Ultrasonic Range." International Tinnitus Journal, vol. 8 No. 1 pp. 3-8. 2002.

* cited by examiner

*Primary Examiner* — Suhan Ni

(74) *Attorney, Agent, or Firm* — Whitham Curtis Christofferson & Cook, PC

(57) ABSTRACT

A waterproof recreational audio device and method that transmits sound via transcutaneous bone conduction provides high fidelity musical signals to a user. The device can be worn on the head of a user and integrated into various types of headgear. The device is tunable for sound quality and comfort by adjusting and moving the sound transmitting transducers around the head of the user. The present invention uses commercially available transducers to produce sounds in the low, mid and high frequency ranges. A sound source for the musical signal can also be provided as part of the waterproof recreational audio device. Controls enable the user to select volume levels for the high, mid and low frequency ranges, while a volume limiter restricts the mid range to a preset maximum volume level to allow external ambient sounds to be heard via the ear canal and protects the hearing of the user.

13 Claims, 11 Drawing Sheets

RECREATIONAL BONE CONDUCTION AUDIO DEVICE, SYSTEM

CROSS-REFERENCE TO RELATED APPLICATIONS

This application is a continuation application of U.S. Ser. No. 10/628,563, filed Jul. 29, 2003, now U.S. Pat. No. 7,310,427, which claims priority to U.S. Provisional Patent Application 60/399,699 filed Aug. 1, 2002, and the complete contents of both prior applications is herein incorporated by reference.

BACKGROUND OF THE INVENTION

1. Field of the Invention

The present invention generally relates to waterproof recreational audio devices and, more particularly, to recreational audio devices that provide high quality musical sound to users through bone conduction sound transmission and the methods related thereto.

2. Background Description

Since the introduction of the Sony Walkman in July of 1979, over 100 million units have been sold. The Oxford English Dictionary certified 'walkman' as a noun in 1986 describing it as a personal audio device. The recreational audio device has established itself as a mainstay for personal music enjoyment. Advances in the personal audio device market have typically been focused in two areas: size of the unit and headphone improvements. Headphones for personal audio systems have historically been air conduction systems that rely on tympanic hearing for sound transmission.

In tympanic hearing, sound travels through the ear canal to the eardrum making it vibrate. These vibrations are passed to three small bones in the middle ear, the ossicles, by a process called air conduction. These in turn pass the vibrations to the cochlea and the fluid it contains. Movement in this fluid bends the tiny hair cells along the length of the cochlea, generating signals in the auditory nerve. The nerve signals pass to the brain, which interprets them as sound. Bone conduction hearing is when sound vibrations are transmitted directly from the skull and jaw bones to the cochlea, missing the outer and middle ears. Air conduction sound systems provide stereo quality sound by taking advantage of the ability of the human brain to take in sound from the two ears and integrating the multiple sound sources into a single, richer sound. While bone conduction devices have traditionally been developed for the hearing impaired and as hearing aid devices until recently, these devices focused on transmitting sound in the speaking voice frequency range and have not been adapted for high fidelity musical signals. Additionally, the recreational audio systems for the underwater environment have traditionally relied on air conduction with ear plugs for the sound transmission.

While small, streamline systems exist for land based recreational audio, they are predominately of the air conduction type. Several of these systems have been waterproofed for use by swimmers. These systems rely on ear plugs that are placed in the ear such that an air bubble is formed in the ear canal. When this bubble is intact, the sound transmission is acceptable. However, the ear canal acoustic resonance is lost if it fills with water while the head is submerged. With bone conduction sound transmission, this disadvantage is overcome. Specifically, when the ear canal is filled with water, as when a swimmer is submerged, the mass of the water (4.5 times denser than air) acoustically loads the ear drum enhancing low frequency sound reception in the ear to bone conduction [Tonndorf, J. A New Concept of Bone Conduction, *Arch Otol* 87, 49-54 1968].

Common bone conduction type devices have been developed to transmit sound in the speech frequency range and have not been maximized to provide musical sound quality. In addition, bone conduction devices have been either large units that were heavy, bulky and uncomfortable for the user or have been devices integrated into a bite plate for sound transmission via the jaw bone (May U.S. Pat. No. 5,579,284). Bit plate type of sound transmission actually requires the user to continually bite down on the device in order to hear the sound.

An audio systems using bone conduction is shown in U.S. Pat. No. 4,791,673 to Schreiber. This invention is an audio listening system that includes both a bone conduction device and a sound source unit. The system has a transducer mounted in a c-shaped element that hooks around the ear of the user. A suction cup element is included as part of the transducer feature to ensure contact from the transducer to the mastoid region behind the ear of the user. This device is water resistant but not waterproof and has only one type of transducer to transmit sound to the user.

A further device is shown in U.S. Pat. No. 5,323,468 to Bottesch that provides a means for the conduction of sound waves through the mastoid bones of the user and selectively amplifying predetermined frequency ranges that the invention claims do not conduct well through the bone so as to maximize the transmission of all signals in the sound source frequency range. The invention is a small, light weight head gear that puts one or several transducers in contact with the mastoid region of the skull. The headgear is designed to provide stereophonic music to the user by transmitting the stereo sound signals separately to transducers located behind the ear of the user. This device is not waterproof and only provides one type of transducer for transmitting across the multiple frequency ranges.

A third bone conduction device is shown in U.S. Pat. No. 5,889,730 to May that provides an underwater audio communication system for transmitting voice through bone conduction at the mastoid region of the head. This device is designed to allow voice communication to and from an underwater user. The device mounts one or more of the same type transducers onto the users scuba face mask. A transceiver and amplifier is located on the back of the users head to transmit and receive ultrasonic sound signals for communication with the user.

SUMMARY OF THE INVENTION

It is therefore an object of the present invention to provide a waterproof recreational audio device to allow a listener to hear high fidelity musical signals through transcutaneous bone conduction.

A further object of the invention is to provide high fidelity sound by maximizing the quality of the sound transmission across the three frequency ranges of musical sound.

Another object of the present invention is to provide an integrated recreational audio system that includes both the headphone unit and the signal source unit.

Additionally, an object of the present invention is to enable the user to position the device on the head for tuning of the sound for the user.

The waterproof recreational audio device of the present invention has an enhanced frequency range over that of previous devices so as to overcome the limited sound quality of existing bone conduction systems. In addition, the present invention is integrated into a light weight headgear that is more comfortable than previous hearing aid type units to enable the individual user to adjust the headgear for personal preferences. The waterproof recreational audio device is also constructed to enable high quality musical signals to be 'heard' while in an underwater environment. However, the intended environment should not be construed as limiting the device to this use. Athletic users may appreciate the light weight, waterproof and streamline configuration of the invention while engaging in other athletic activities such as running, biking, hiking, etc.

According to the present invention, the foregoing and other objects are achieved in part by having a transducer in contact with the skull of the user for transmitting musical signals via bone conduction. The musical signals differ from ordinary speech in that the average frequency range for normal speech is approximately 120 Hz to 8,000 Hz, while high fidelity musical signals can range from 20 Hz to over 20,000 Hz. This range can be extended even further to meet the newer digital sampling technology with high frequencies of almost 40,000 Hz.

The present invention has at least one transducer that is able to transmit transcutaneous sound via bone conduction through the head of the user. The present invention is functional with at least one transducer, however, at least one transducer should also be understood to include a plurality of transducers. An amplifier can also be worn on the head of the user or can be part of a signal source unit to which the transducer or transducers are connected. The present invention is intended to be worn on the head of the user. The transducer may be fixed to a band that encircles the head of the user or other head gear such as hats, helmets, headbands, or eye wear such as goggles, face mask or sun glasses.

The musical frequency range is split into three distinct channels by the present invention. That is: low frequency from 0 Hz to 1000 Hz, mid frequency from 25 Hz to 6,000 Hz and high frequency from 5,000 to over 20,000 Hz. With new digital sampling device, the upper end frequency range can extend to as high about 40,000 Hz. The present invention can use commercially available transducers coupled with the amplifier to produce sound in the mid frequency range. The low frequency response is achieved by applying very low frequencies to the head using a vibrotactile transducer. To provide the high frequency musical signal to the user, the present invention can also include an ultrasonic transducer. The ultrasonic transducer may be of a piezoelectric type or similar. Each channel requires special amplification provided by the invention. The low frequency has low impedance whereas the high frequency device has about 10 times the impedance. Thus, the three channel amplifier is designed to three different impedances. In addition, each of these frequency channels can have their own volume adjustment. The upper end of the volume can be preset to reduce potential damage to the listener. The preset volume can also be limited specifically for the mid frequency range to allow the user to hear external environmental sound and to provide a volume limit such that others in close proximity to the user do not hear the sound signal from the present invention if the device is worn other than underwater.

Perceptually, bone conduction using the three channels of sound, results in a high fidelity sound quality for the purpose of music listening. The three channels, when listened to underwater, permit a flexible sound quality that allows changes in the sound envelope appropriate for musical articulation. The low frequency range channel proposed is conducive to low and high pitch sounds that enhance the appreciation of both human voice and instrumental applications for music. With air conduction minimized by water or earplug, the proposed device also offers unique clarity with minimal distortion. Further, the impediment of air conduction, through water or earplug, with this device also reduces noise that can hamper music appreciation. The sound quality from the three channel device with its three transducers is omnidirectional when heard underwater. With ear masking as described, it has a timbre that is comparable to high fidelity instrumentation with above-surface stereophonic attributes.

The waterproof recreational audio device can also enhance the music signal by enabling tuning of the device to the individual users preference through positioning of the transducers on the users head. The human skull is very asymmetrical with regard to its vibratory response. In addition, there are idiosyncratic vibratory differences due to individual specific skull geometries [Cai, Z., Richards, D. G., Lenhardt, M. L. and Madsen, A. G., Response of the Human Skull to Bone Conducted Sound in the Audiometric to Ultrasonic Range., *International Tinnitus Journal,* 8, 1, 1-8, 2002]. The transducers of the device can be placed in a standard position (i.e., over the ear in the mastoid region and on the forehead in the frontal region, etc.). However, the sound quality may not be considered optimum for some users. To compensate for the acoustics in skull geometry, the transducers can be placed on the head band 180° apart, or at another desired orientation, allowing the user to rotate the band around the head to select the position of best music reception. This can be readjusted underwater due to the different acoustic properties of that medium and its interaction with the head. In a second embodiment, each transducer may be moveable about the head band independently, until the best sound reception is achieved. This allows custom tuning for each frequency band resulting in the greatest user satisfaction.

As a waterproof recreational audio device, the present invention has a further embodiment that integrates the sound source with the sound transmission. This sound source can be in the form of a disk player (e.g., CDs, DVDs, minidiscs, etc.), MP3 player, AM/FM radio, audio transceiver or other such devices known as personal audio devices. The sound source can communicate with the transducers by wireless or wired connection.

Finally, the objects are met by providing the functional elements and a method for positioning the transducers at various locations on the head of the user. The transducers may be fixed to the band or other head gear and the head gear would be rotated around the head. In addition, the transducers may be able to slide to different locations around the head gear. Finally, the transducers may be able to be removed from the head gear and then to be replaced in another location around the head gear. As a minimum, the user should be able to locate transducer at the front and the back of the head. By moving the transducers, the user may improve both perceived personal sound quality and personal comfort for wearing the device.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
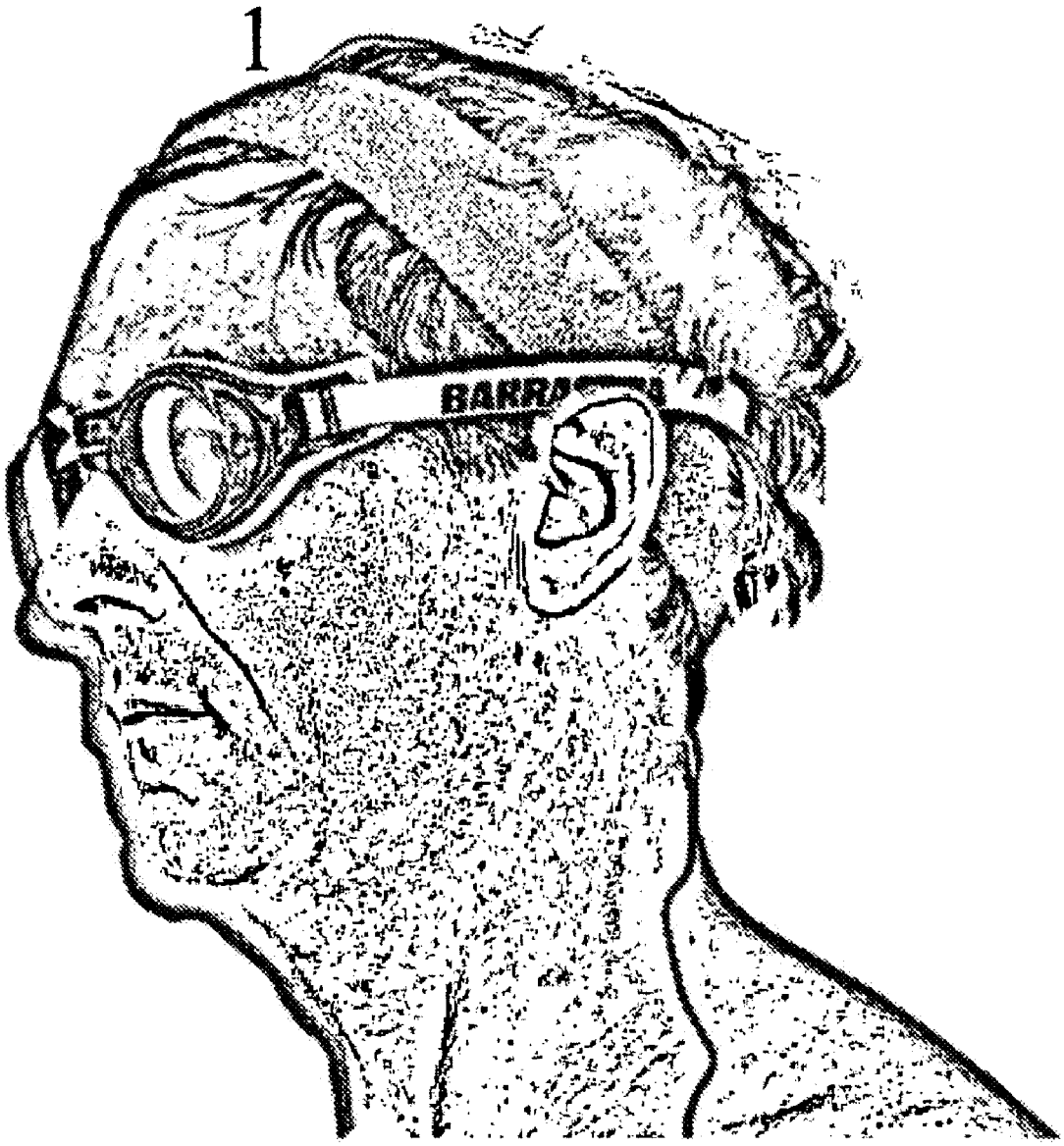
FIG. 1 shows a user wearing the waterproof recreational audio device, system as a head band.
Figure 2:
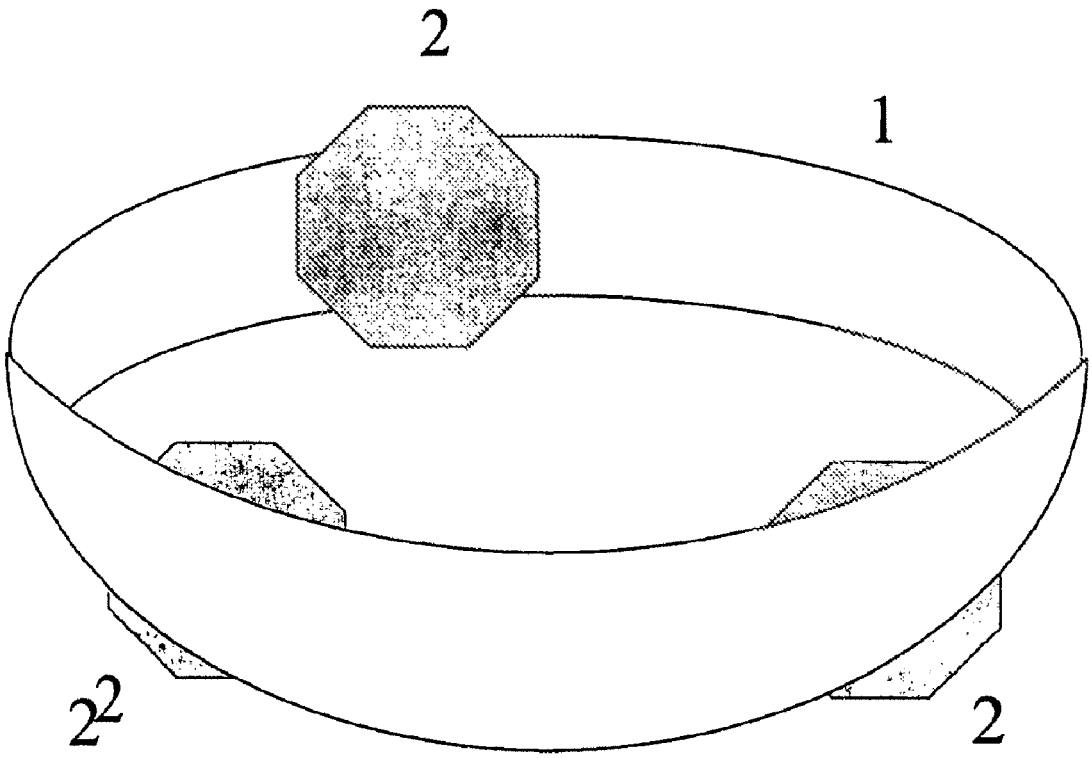
FIG. 2 shows one or several transducers located within the headband.

Referring now to the drawings, and more particularly to FIG. 1, the preferred embodiment of the waterproof recreational audio device is as a comfortable, light weight head band 1 worn by a user. The head band 1 in FIG. 1 can be worn with eye wear such as swimming goggles. The transducer 2 is located on the inside of the head band 1 to allow contact with the head of the user as shown in FIG. 2. Sealed, waterproof wiring (not shown) would be located inside the head band for connecting to a signal source.

One of the major advantages of the waterproof, recreational audio device is the tuning capability. The skull has many vibratory modes which are likely to be specific to an individual. The unique vibratory pattern of a head is a product of the skull and brain complex geometry, mass and other acoustic properties. The listener compensates for poorly propagating areas of the skull by moving the transducer 2 around the head until optimal sound quality is obtained. Placement at different locations (frontal, temporal parietal occipital etc.) may dramatically improve listening quality since the head is part of the propagating medium for bone conducted sound on the way to the inner ear.

Figure 3A:
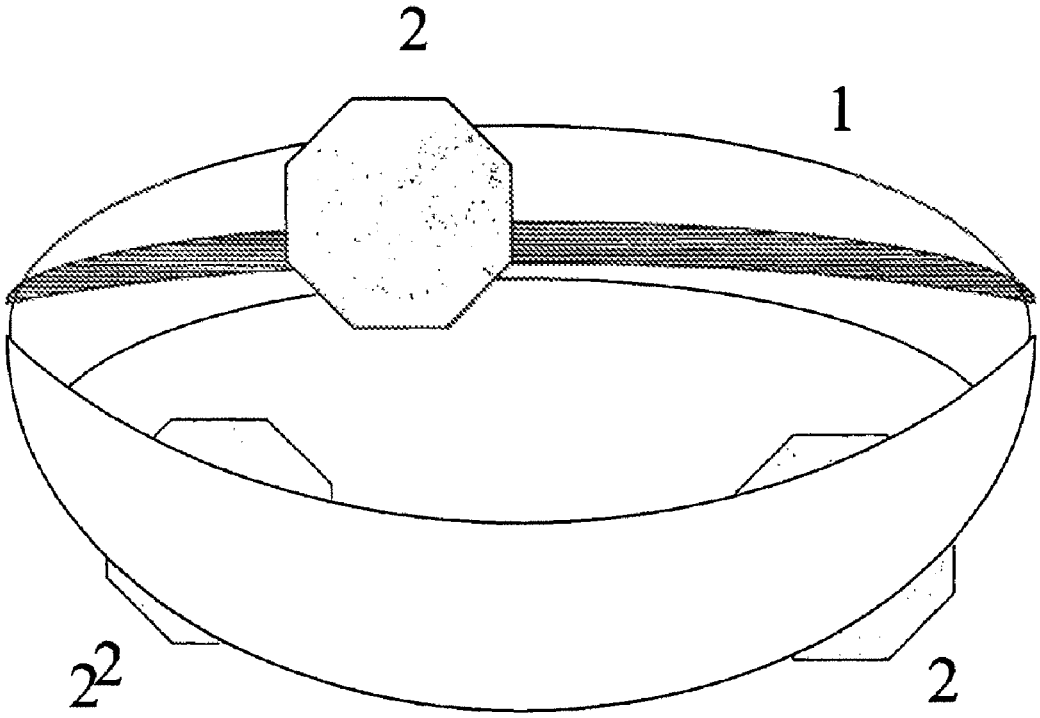
FIG. 3*a* shows the means of connecting and moving the transducers relative to the user and the head band by sliding the transducers along a guide on the head band.
Figure 3B:
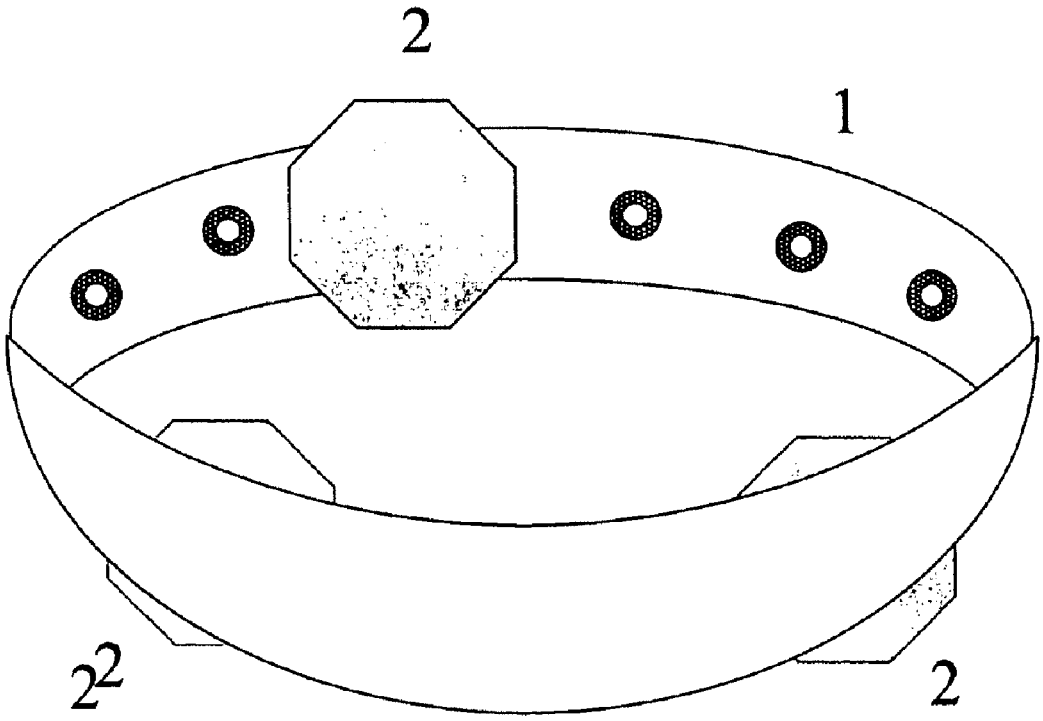
FIG. 3*b* show the means of connecting and moving the transducers relative to the user and the head band using hooks or snaps.
Figure 3C:
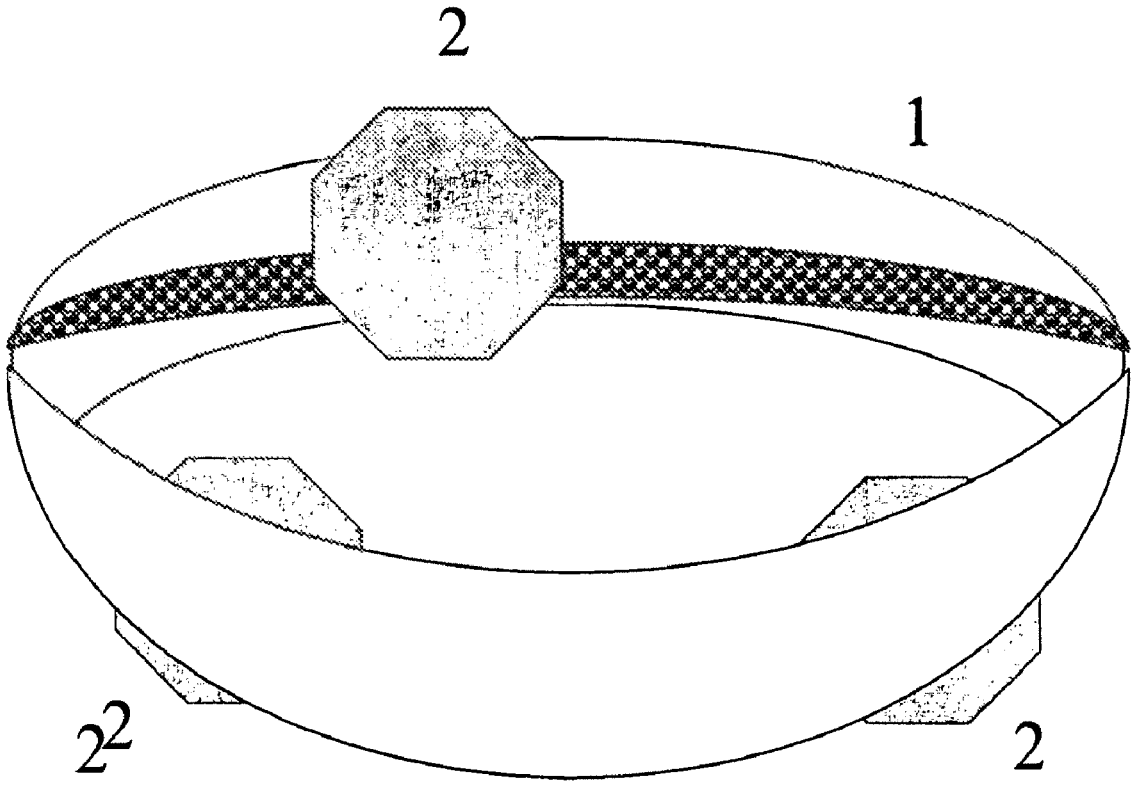
FIG. 3*c* show the means of connecting and moving the transducers relative to the user and the head band using Velcro.

A preferred configuration is to have two or more transducers 2 located at different positions around the head band 1 (e.g., 180° apart). The user could then tune the sound by rotating the head band 1 around the head. Another means for tuning the sound would be to locate the transducers 2 by sliding them around the head band 1 on a slide positioning guide 3 shown in FIG. 3*a*. FIG. 3*b* shows the use of hooks/snap positioning means 4 connections that would be used to locate the transducers 2 at several positions around the head band 1. FIG. 3*c* shows hook and loop material (e.g., Velcro®) inside the head band 1 as the means to allow the user to remove and replace the transducers 2 in preferred positions around the head band 1 for tuning.

Figure 4:
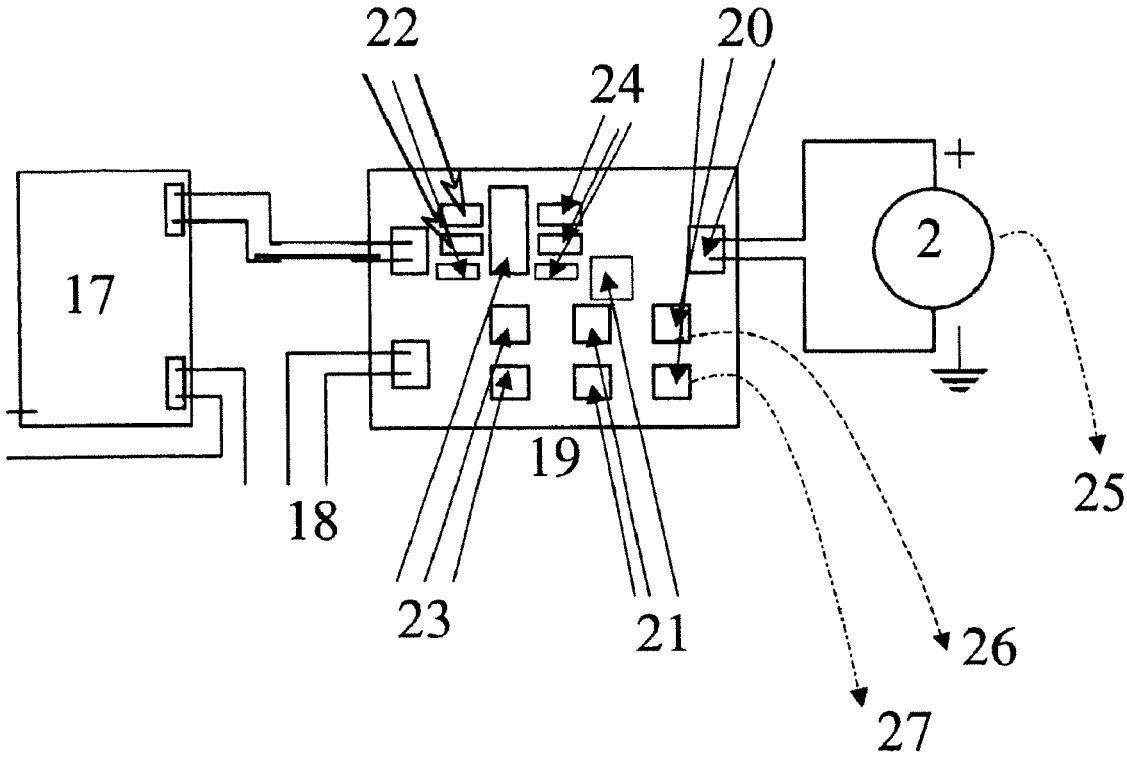
FIG. 4 shows a simple block diagram for amplifier unit.

In order to maximize the sound quality of the musical signal, the sound source is amplified and split into three frequency channels. The amplifier unit shown in FIG. 4 is powered by a battery 17. A source signal 18 is received from the sound source and presented to the pre-amps 22 on the driver board 19. The signal source is split into the three frequency channels by the band pass filters 24.

Amplifiers 23 further enhance the low frequency channel, mid frequency channel, and high frequency channel signals. There are three attenuators 21, each controls the volume in each of the frequency channels. The listener increases the volume until comfortable in each channel. In this way compensation for the individual differences in sensitivity or preference is obtained. The mid frequency attenuator is preferably set with a maximum level of 90 dBa for 8 hours to limit the volume of the mid range such that individuals near the listener should not be able to hear the sound.

The three channel signal drivers 20 couple the signal to the appropriate transducer 2. The low frequency transducer 2 can be an Audiological Engineering Inc. device or similar device. The mid frequency transducer 2 can be a Radioear Corporation device or similar device, and the high frequency transducer 2 can be a custom designed device from Blatek Inc. further described in FIG. 5*a*, or a similar device. The high frequency sound signal 25, mid frequency sound signal 26 and low frequency sound signal 27 are heard by the user through contact with the transducers 2 to the head of the listener.

Figure 5A:
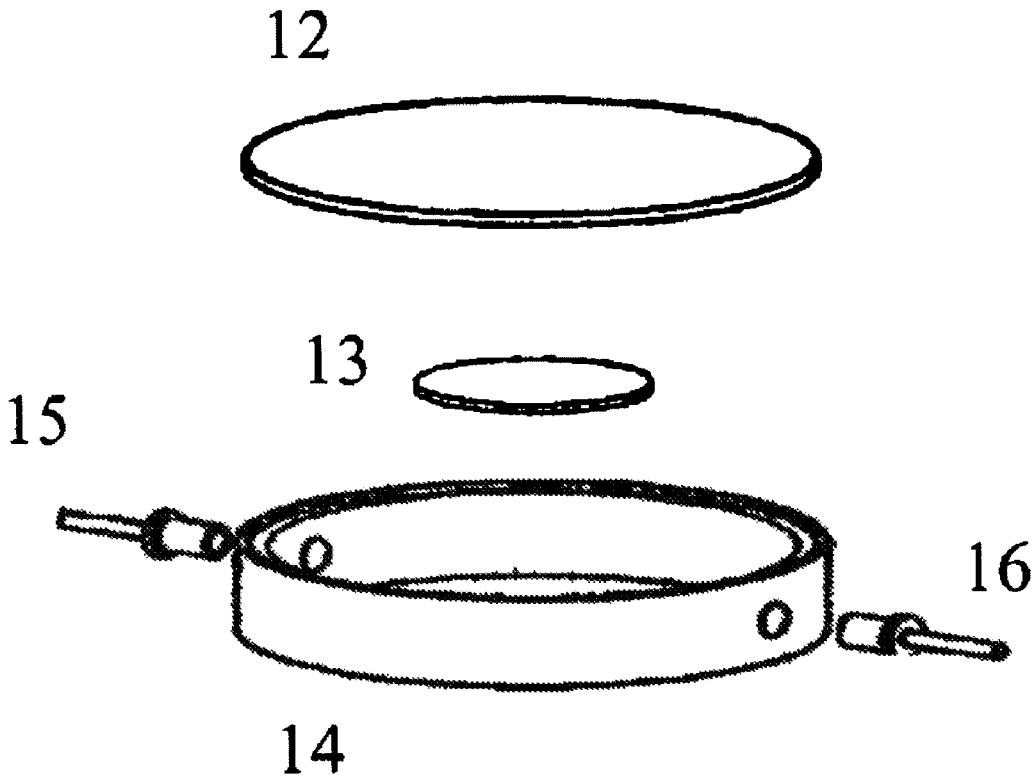
FIG. 5*a* shows the components of the high frequency transducer.

The high frequency transducer shown in FIG. 5*a* may be constructed to include of a 1.215 inches dia.×0.032 inches thick aluminum disk 12. The aluminum disk 12 is located on top of the 0.05 inches dia.×0.020 inches thick Lead Zirconate Titanate (PZT) disk 13. The PZT (ultrasonic) disk 13 sits within an Aluminum collar 14 that has an outer diameter of 1.25 inches with a wall thickness of 0.052 mm. The size of the components can vary, which will alter the vibratory response. This may be valuable in some applications. The aluminum collar 14 has a recess machined such that the aluminum disk 12 fits flush along the top of the aluminum collar 14, and the PZT disk 13 vibrates within the cavity created by the aluminum collar 14 and the aluminum disk 12. The signal source is received by the transducer via the wire connected to the insulated solder pin 15 and is grounded by the case ground solder pin 16. The insulation pin can be replaced on one side allowing the connector wire to cross the interior of the transducer.

The intended embodiment of the waterproof recreational audio device/system is to be able to operate in underwater and other high humidity environments. Examples of sub-aquatic, underwater environments include, but are not limited to, recreational and competitive swimming. However, it also includes, but is not limited to, scuba diving or other deeper water environments. Examples of above-water, high humidity environments include, but are not limited to, jogging, bicycling, hiking or other recreational activities that might expose the device and ear canal to excessive moisture, such as with rain, thereby interfering with normal air-conducted sound.

Figure 5B:
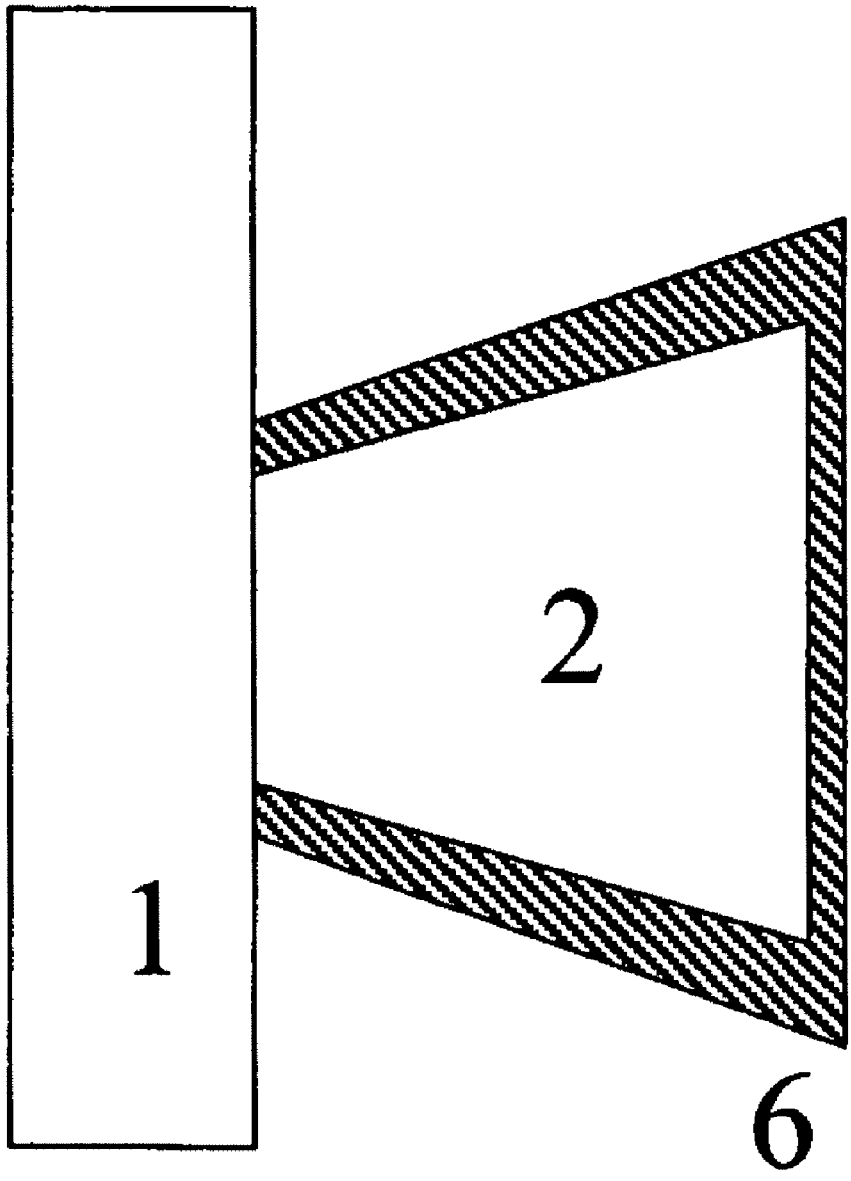
FIG. 5*b* shows one embodiment of waterproofing on a cross section of a transducer with the head band.

As such, in most applications of the invention, the transducers should be waterproof FIG. 5*b* shows a cross section of the transducer 2 connected to the head band 1. The transducer 2 preferably is waterproofed by rubberized or polymer coating 6. Water proofing is a accomplished by silicone sealing or silicone gaskets may also be used. The main function of the waterproofing is to protect the transducers from a water or humid environment (e.g., rain), while at the same time allowing the transducers to transmit, via bone conduction, the musical signal to the wearer. As such, any waterproofing that accomplishes this objective might be used in the practice of this invention.

Figure 6A:
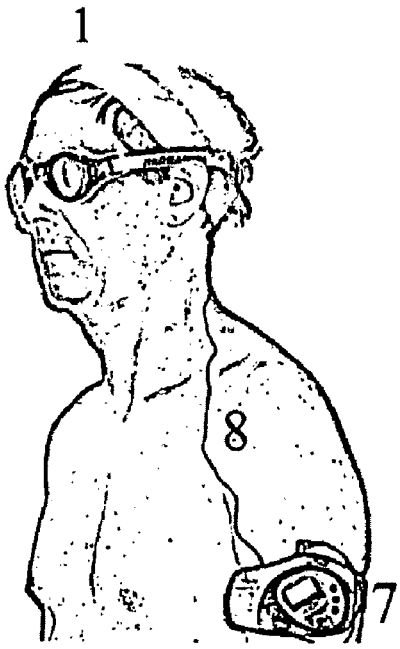
FIG. 6*a* shows a wired connection to a sound source.
Figure 6B:
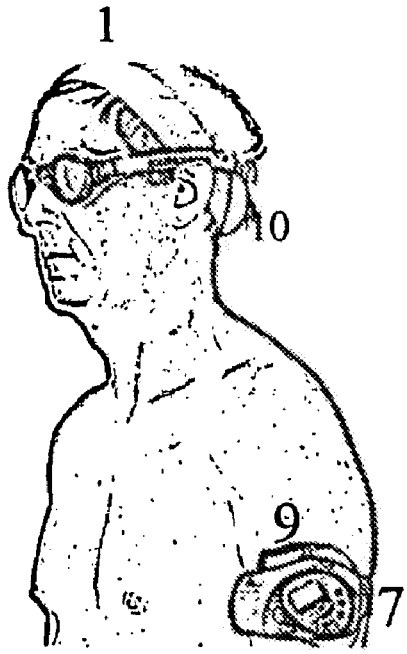
FIG. 6*b* shows a wireless connection to a sound source.

Another embodiment of waterproof recreational audio device is to include the sound source as part of the system. The sound source can be an MP3 player, CD player, or other portable musical device. The sound source 7 can be worn on the arm of the listener as shown in FIGS. 6*a* and 6*b*. The sound source is coupled to the head band 1 by a wired connection 8 shown in FIG. 6*a* or by a wireless connection as shown in FIG. 6*b*. The wireless connection would comprise a sound source wireless means 9*a* that would communicate with the head band wireless means 9*b* by transmitting and receiving the sound signals as radio, supersonic, or similar transmission means.

Figure 7:
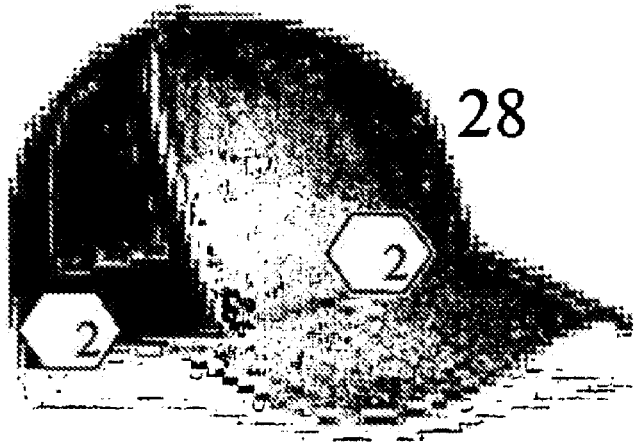
FIG. 7 shows a configuration of the device attached to a hat.
Figure 8:
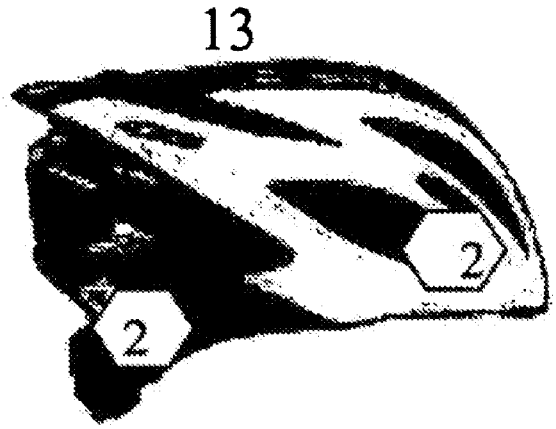
FIG. 8 shows a configuration of the device attached to a helmet.
Figure 9:
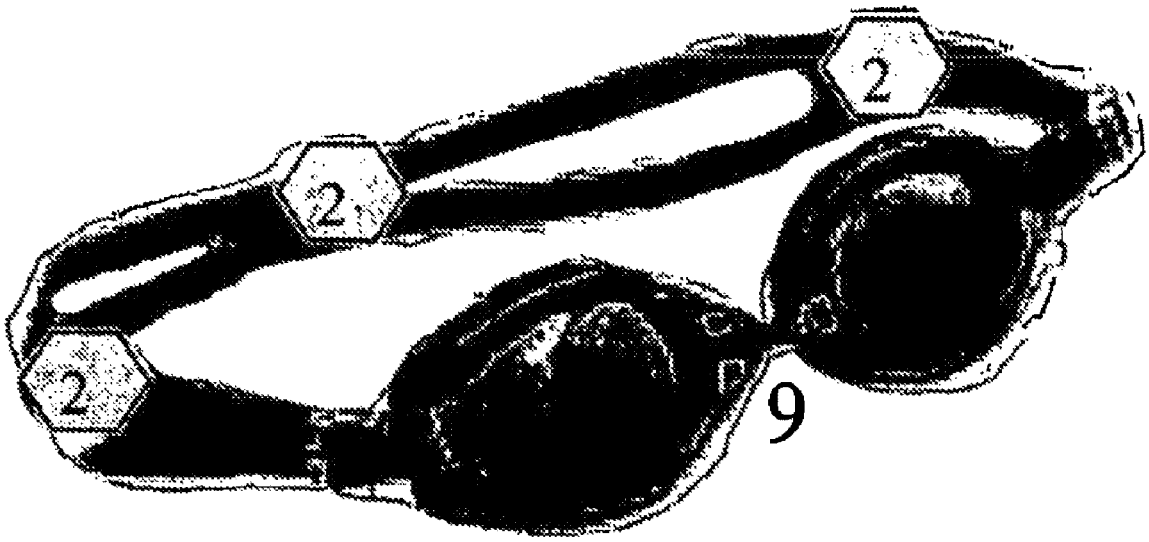
FIG. 9 shows a configuration of the device attached to swim goggles.

Although the preferred embodiment is a head band 1, the listener may want to use other types of head gear to position the transducers 2 in contact with the head. FIG. 7 shows the transducers 2 are preferably located within a hat 28 that would be worn by the user. The transducers 2 are located inside the hat, next to the head of the listener. Other embodiments would be to locate the transducers 2 inside a helmet 29, such as a bike helmet 29 shown in FIG. 8 or to locate the transducers 2 on the band of eye wear such as the goggles 30 shown in FIG. 9.

Figure 10:
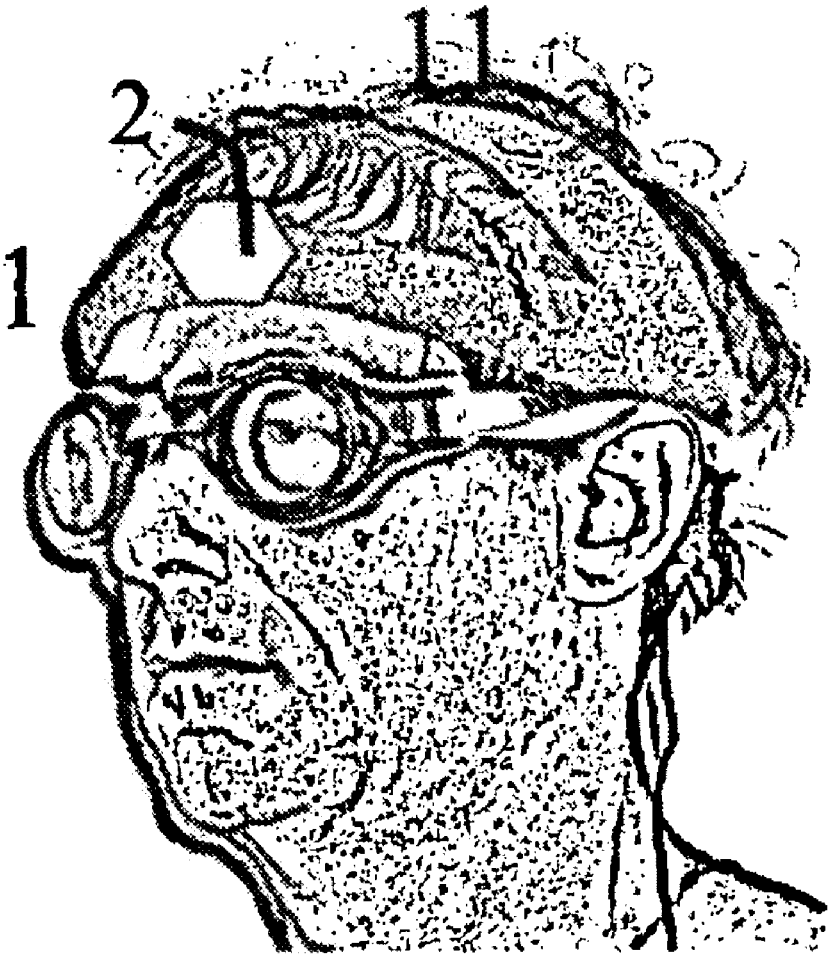
FIG. 10 shows another embodiment with a transducer located on the frontal region of the head and a stabilizing strap across the top of the user's head.

Comfort of the user and tuning of the signal are major features for the waterproof recreational audio device. In the event a user wants to position at least one of the transducers 2 on the frontal region of the head, a stabilizing strap 11 is available to hold the head band 1 more securely when a transducer 2 is fixed to the frontal position as shown in FIG. 10. The amplification at the three different frequency bands can be independently adjusted providing a personalized audio experience of high fidelity. Unlike air conduction, in which the pathway is the same for all frequencies, the skull unique geometry for each individual requires the device to be tune for maximum satisfaction. Tuning the frequency bands is accomplished by manipulating three attenuators, each of which controls the volume in each of the frequency channels. The listener increases the volume until comfortable in each channel. When all are at a comfortable listening level the user can fine tune the response of all three channels in air and again underwater. In this way compensation for individual differences in sensitivity or preference is obtained. If the listeners wishes the audio image to appear in the center of the head, careful adjustment of the volume is necessary in all three channels Tuning the volume of the three channels still may not result in the optimal high fidelity experience of sound in the head. Tuning the transducers to the head by positioning may be required. The skull has many vibratory modes which are likely to be specific to an individual. The unique vibratory pattern of a head is a product of the skull and brain complex geometry, mass and other acoustic properties. The listener compensates for poorly propagating areas of the skull by moving the transducers around the head until optimal sound quality is obtained. Placement at different locations (frontal, temporal, parietal, occipital, etc.) will dramatically improve listening quality since the head is part of the propagating medium for bone conducted sound on the way to the inner ear. Transducer adjustment underwater may also be necessary given that medium's difference in acoustical properties from air.

The fidelity of the sound underwater with the device may be enhanced by ear plugging through a masking phenomenon that reduces sound interference of impeded air-conducted sound. This ear plugging can be accomplished with commercially available ear plugs (e.g., silicon); or, at a suitable water depth, there will be normal water loading of the external auditory canal. However, the latter method may not be reliable with recreational or competitive swimming, and ear plugging may be desired. The user may elect, however, not to use ear plugs, and a quality fidelity sound will still be accomplished with the device. Placing plugs in the ear canal changes the quality of sound by bone conduction. This is termed the occlusion effect (Tonndorf, J. A new concept of bone conduction, *Arch Otol* 87, 49-54, 1968) and it enhances bone conduction listening by increasing the perception of lower frequency sound. The use of plugs or not is the listeners choice. Plugs will require intensity adjustment and possibly transducer placement on the head to create the optimal audio experience.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. An audio device for providing music to a user, comprising:

a plurality of bone conduction transducers;

a support for said plurality of bone conduction transducers which can be worn on or secured to a user's head, wherein said support secures said plurality of bone conduction transducers in contact with said user's head at locations other than ears of said user to provide audio signals to said user by bone conduction, and wherein at least one of said plurality of bone conduction transducers is moveable to different locations on said support.

2. The audio device of claim 1 wherein said support is a hat.

3. The audio device of claim 1 wherein said support is a helmet.

4. The audio device of claim 1 further comprising waterproofing material disposed over each of said plurality of bone conduction transducers.

5. The audio device of claim 1, further comprising:

a source for providing said audio signals with multiple frequency channels;

wherein said plurality of bone conduction transducers are configured to operate over the multiple frequency channels; and control means for independently controlling audio signals at each of said multiple frequency channels.

6. The audio device of claim 5 further comprising waterproofing material disposed over each of said plurality of bone conduction transducers.

7. The audio device of claim 5 wherein each of the plurality of bone conduction transducers is configured to be removably secured to said support.

8. The audio device of claim 5 wherein said support is a hat.

9. The audio device of claim 5 wherein said support is a helmet.

10. The audio device of claim 5 wherein said support includes a strap on swimming goggles.

11. The audio device of claim 5 wherein said source is secured to said support.

12. The audio device of claim 1 wherein said support includes a strap on swimming goggles.

13. The audio device of claim 1 further comprising a source of music which is secured to said support.

* * * * *